United States Patent [19]

Errani

[11] 3,967,080

[45] June 29, 1976

[54] SWITCH DEVICE FOR INDICATING THE UNDUE OPENING OF DOORS AND CLOSING-WINGS

[76] Inventor: Deo Errani, Via Cavour 44/1, Faenza (Ravenna), Italy

[22] Filed: Aug. 12, 1974

[21] Appl. No.: 496,787

[30] Foreign Application Priority Data

Aug. 29, 1973 Italy ..... 3478/73

[52] U.S. Cl. ..... 200/61.64; 200/61.68; 200/61.82

[51] Int. Cl.[2] ..... H01H 27/00; H01H 3/16

[58] Field of Search ..... 200/61.62–61.83, 200/61.93; 340/274

[56] References Cited

UNITED STATES PATENTS

| | | | |
|---|---|---|---|
| 2,660,632 | 11/1953 | Makishima | 340/274 UX |
| 3,263,040 | 7/1966 | Bliven | 340/274 X |
| 3,694,595 | 9/1972 | Horecky | 200/61.76 |
| 3,810,145 | 5/1974 | Gusaras | 340/274 |

*Primary Examiner*—James R. Scott
*Attorney, Agent, or Firm*—Guido Modiano; Albert Josif

[57] ABSTRACT

An intrusion detector device for signalling undue opening of doors and closing-wings in general. The device is housed in a cavity of the door jamb and comprises means for supporting an alarm controlling switch and an element swinging supported and retained in an inoperative position by elastic means, said element being engageable by a lock bolt or pin projecting from the door when an undue force is exerted on the door, thus causing said element to rotate in an operative position in which said switch actuates an alarm.

4 Claims, 9 Drawing Figures

SWITCH DEVICE FOR INDICATING THE UNDUE OPENING OF DOORS AND CLOSING-WINGS

BACKGROUND OF THE INVENTION

This invention relates to an intrusion detector device for signalling the undue opening of doors and closing-wings in general.

The action of house breakers in breaking open doors notably consists of inserting a crowbar between the doorjamb and door to force the bolt out of its insertion seat.

To signal this method of housebreaking, locks have already been proposed having a bolt which, when thrust transversely by the crowbar force, becomes obliquely disposed in opposition to elastic return means, so as to close a switch which controls an electrical alarm apparatus.

The need to support the bolt in an articulated manner to enable it to become disposed obliquely during forcing evidently renders the structure of the lock very complicated, because of which this type of lock has very considerable economical disadvantages.

SUMMARY OF THE INVENTION

The object of the present invention is to provide an intrusion detector device of economical manufacture which can be easily mounted at any point of the perimeter of the door or closing-wings so as to foil any neutralising operation by the house breakers.

This object is attained by an intrusion detector device comprising a plate member fixed to the door jamb and closing a cavity formed therein, an aperture formed in said plate member and adapted to receive a bolt of a lock or a pin mounted on said door adjacent said plate member, means for supporting an alarm controlling switch mounted on said plate member and arranged in said cavity, said alarm controlling switch having normally open contacts, a swinging element for actuating said alarm controlling switch pivoted on said plate member and located in said cavity, springs means biasing said element to a rest position in which said contacts are open, said swinging element being adapted to be engaged by said bolt or pin when undue pressure is exerted on the door, thus causing closing of the contacts of the switch.

BRIEF DESCRIPTION OF THE DRAWINGS

Further characteristics of the invention will be more evident from the detailed description given hereinafter of two embodiments illustrated by way of example in the accompanying drawings in which.

DESCRIPTION OF A PREFERRED EMBODIMENT

Figure 1:
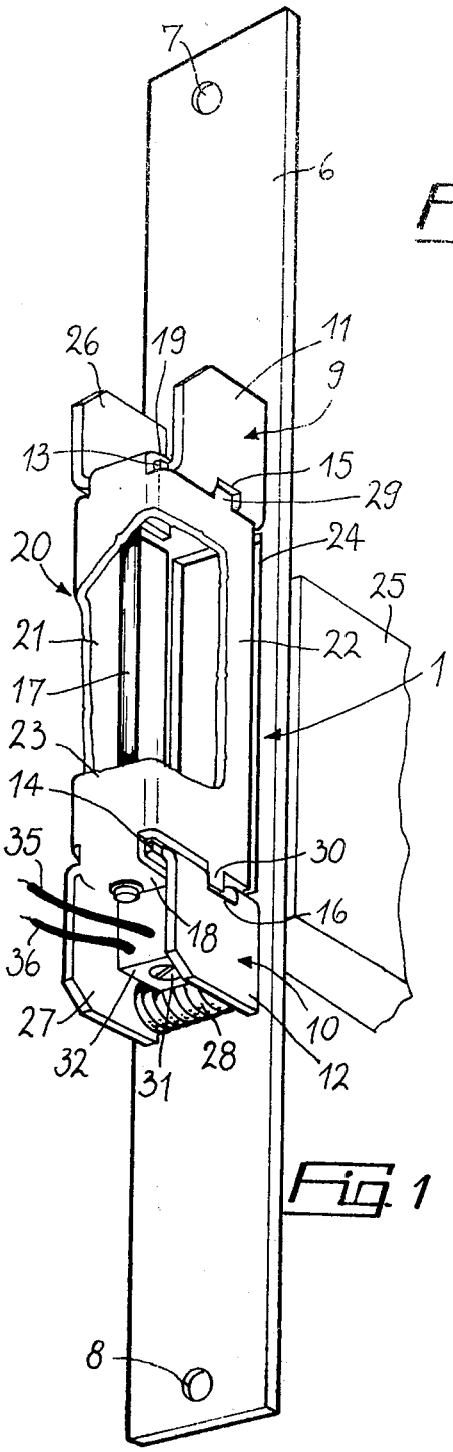
FIG. 1 is a perspective partially sectional view of a first embodiment of an intrusion detector device according to the present invention.
Figure 2:
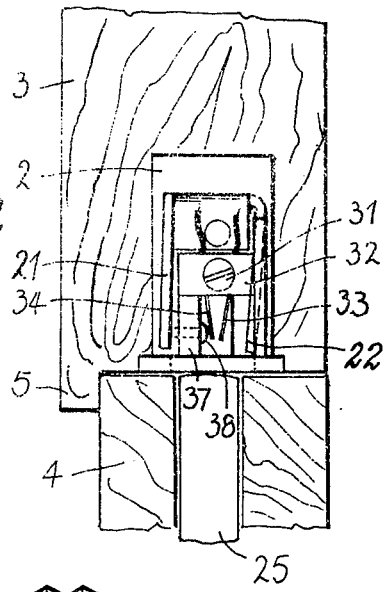
FIG. 2 is a longitudinal view of the device of FIG. 1 arranged in a door jamb cavity.
Figure 3:
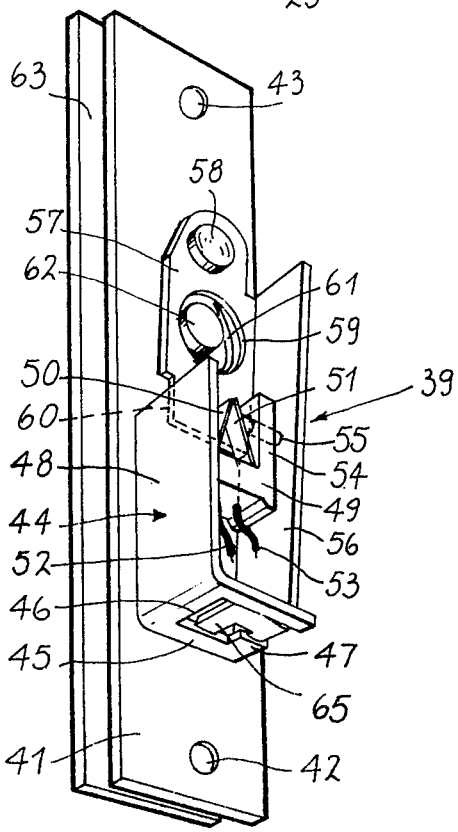
FIG. 3 is a perspective view of a second embodiment of an intrusion detector device in accordance with the present invention.
Figure 6:
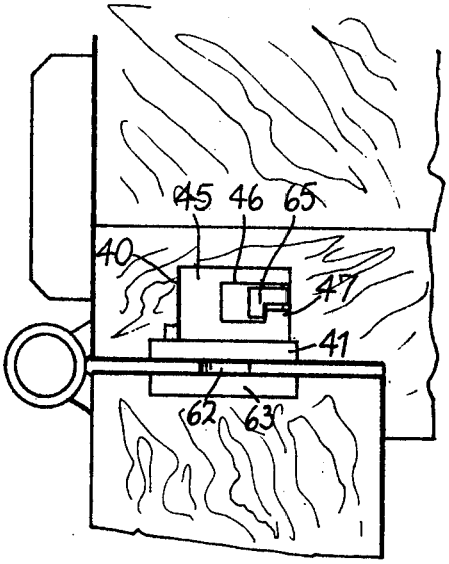
FIGS. 6 and 7 are views on the lines VI—VI and VII—VII of the devices of FIGS. 4 and 5 in respective door jamb cavities.

With reference to FIGS. 1 and 2, the intrusion detector device is indicated overall by 1. It is considered installed in a cavity 2 in the doorjamb 3, against which the door 4 abuts. The described device 1 is of the type which indicates the forcing of the door following the lateral movement of the lock bolt by the external action of a housebreaking implement inserted between the door 4 and the abutting shoulder 5 of the door jamb, as can be seen from FIG. 7 relative to the second embodiment of the invention.

The device is consequently disposed in the door jamb in a position adjacent the lock, which is normally fixed to the door.

The device comprises a rectangular plate 6 in which the holes 7, 8 are formed for the passage of the screws by which the plate is fixed into a frontal seat in the doorpost to close the cavity 2.

With the plate 6 are rigid two brackets 9, 10 of which the sides 11,12 are coplanar to each other and parallel to the longitudinal edges of the plate 6, while the sides 13, 14 are perpendicular to the sides 11,12. In the corners of the brackets 9, 10 there are notches 15, 16, and the sides 13, 14 are traversed by a rod 17.

To the end portions of this rod 17, which project beyond the sides 13, 14, are articulatedly supported the lobes 18, 19 of swinging element indicated generally by 20 and comprising two parallel fins 21, 22 connected by an intermediate portion 23. The rod 17 is retained at its ends by elastic rings, and thus acts as an articulation axis for the element 20.

The element 20 is of substantially U form open towards a rectangular aperture 24 formed in the plate 6 and, in alignment with the bolt 25 of a lock, not shown mounted on the door, so that when the door is in the closed position the bolt may penetrate between the fins 21, 22.

Arms 26, 27 are fixed to the lobes 18, 19 and are parallel to the sides 11 and 12 respectively of the brackets 9, 10.

Between the arm 27 and side 12 there is a helical cylindrical spring 28 operating by compression. An analogous spring, not shown on the drawing, is disposed between the arm 26 and side 11. By the action of these springs, the element 20 is caused to rotate and its arrest is determined by teeth 29, 30 which engage the notches 15, 16.

As can be seen in FIG. 2, the penetration of the teeth 29, 30 into the notches 15, 16 is such that the fins 21, 22 are slightly inclined to the vertical plane perpendicular to the plate 6. Following this inclination, the front edge of the fin 22 close to the plate 6 faces the aperture 24 and restricts the bolt the width thereof so as to permit however the bolt 25 to be inserted.

A block 32 of insulating plastics material is fixed to the bracket 12 by a screw 31. Said block 32 supports a pair of elastic tangs 33, 34 which form the switch to which the leads 35, 36 of an alarm apparatus, not shown, are joined. In a projection 37 of the block 32, a pin 38 is slidably guided which at one end is in engagement with the arm 27 and at the other end rests on the tang 34.

The operation of the described device is as follows. When the door 4 is closed and the bolt 25 is inserted between the fins 21, 22 of the device through the aperture 24, any undue pressure exerted from the outside on the door 4 will cause the bolt 25 to be urged against the fin 22, thus causing the element 20 to rotate about the rod 17. Following this rotation, the fin 21 acts on the pin 38 which deflects the tang 34 and brings it into contact with the tang 33 so actuating the alarm apparatus and thus signalling the housebreaking operation.

In the embodiment shown in FIGS. 3 – 7, the device according to the invention is indicated overall by 39 and is advantageously housed in a cavity 40 provided of any point in the vertical door jamb on the bringing side of the door. The device comprises a rectangular plate 41 provided with holes 42, 43 for the passage of screws by which it is fixed into a seat in the doorpost to close the cavity 40.

A bracket 44 is rigid with the plate 41 and in the side 45 transverse to the plate there is an aperture 46 defining a tooth 47. On the inner face of the longitudinal side 48 of the bracket is fixed a block 49 of insulating material supporting a pair of elastic tangs 50, 51 to which the leads 52, 53 of an alarm apparatus, not shown, are connected. In a projection 54 of the block 49 a pin 55 is slidably guided, resting at one end on the tang 51 and at the other end on the inner face of a fin 56 bent at right angle with respect to the plate 41 of a swinging element 57. This element 57 is pivoted at 58 on the plate 41 and comprises a central aperture or hole 59 and an edge 60 by which it abuts against the side 48 of the bracket 44.

In a position opposite the hole 59, the plate 41 comprises a hole 61 of equal diameter which is displaced towards the fin 56 with respect to the previous hole when the element 57 is in inoperative position. The holes 59 and 61 are traversed by a pin 62 rigid with a plate 63 fixed onto the edge of the door in a position adjacent the plate 41. When the device is inoperative the pin 62 is concentric with the hole 61 and approximately tangential to the inner edge of the hole 59.

The described device is completed by a spring 64 disposed between the side 48 and fin 56 and acting in compression. When the device is at rest position, the fin 56, urged by the spring 64, is retained by a hook portion 65 which engages with the tooth 47.

Figure 7:
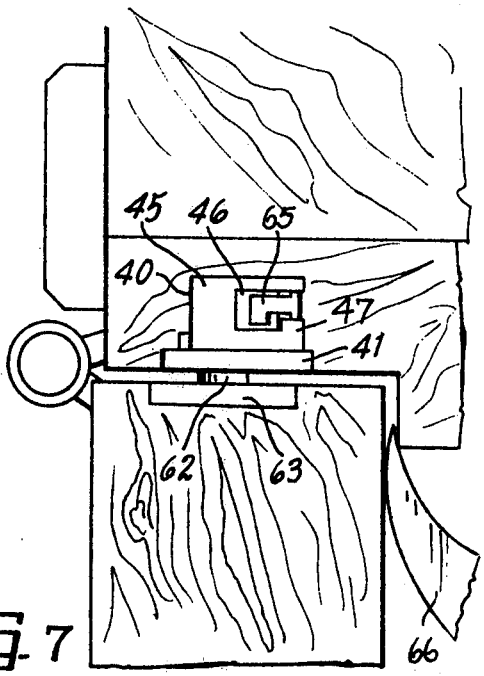
Figure 4:
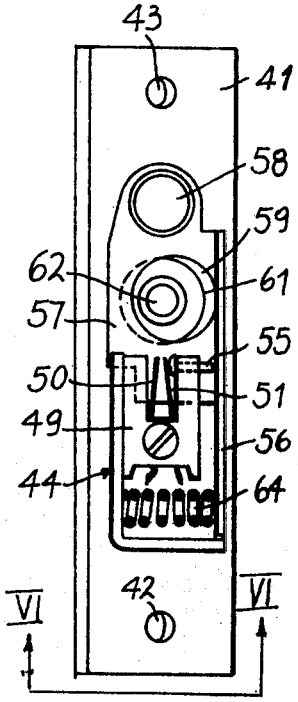
FIGS. 4 and 5 are front views of the device shown in FIG. 3 in two different working positions.
Figure 5:
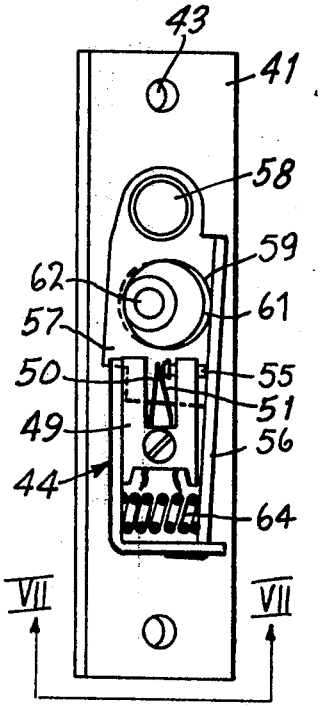
Figure 8:
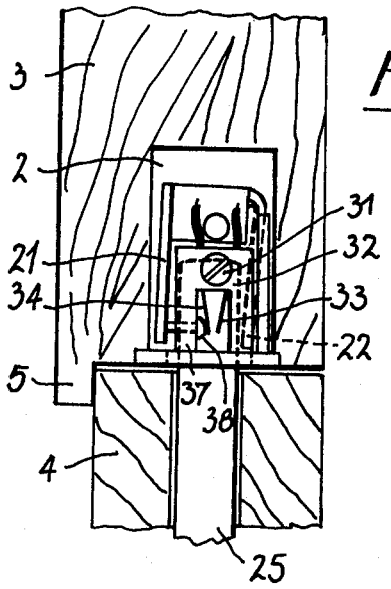
FIGS. 8 and 9 show longitudinal views similar to that of FIG. 2 in which however the bolt is in engagement in the door jamb and the alarm controlling switch is in an inoperative and operative position respectively.
Figure 9:
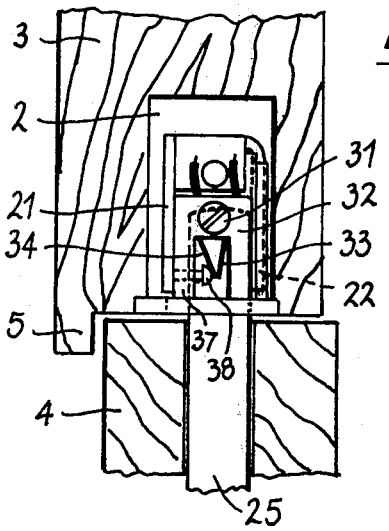

The operation of this second embodiment of the device is analogous to the operation of the previous embodiment with the difference that the action which previously was carried out by the bolt 25 is now carried out by the pin 62. When an undue force is exerted on the door, owing to a housebreaking operation carried out by an intruder by means of a crowbar 65 inserted from the outside between the door and the abutting shoulder of the door jamb, as shown in FIG. 7 the pin 62 moves in the hole 61 until it pushes against the edge of the hole 59 and causes the element 57 to rotate. The fin 56 thus pushes the pin 55, against the tang 51 which comes into contact with the tang 50 and sets off the alarm apparatus.

I claim:

1. An intrusion detector device for detecting the undue opening of a door comprising a plate member fixed to the door jamb and closing a cavity formed therein, an aperture formed in said plate member and adapted to receive a bolt of a lock or a pin mounted on said door adjacent said plate member means for supporting an alarm controlling switch mounted on said plate member and arranged in said cavity, said alarm controlling switch having normally open contacts, a swinging element for actuating said alarm controlling switch pivoted on said plate member and located in said cavity, spring means biasing said element to a rest position in which said contacts are open, said swinging element being adapted to be engaged by said bolt or pin when undue pressure is exerted on the door, thus causing closing of the contacts of the switch.

2. A device as claimed in claim 1 comprising a plate member fixed to the door jamb and closing a cavity formed therein, an aperture formed in said plate member for receiving a bolt of a lock mounted on said door adjacent said plate member and adapted to permit transverse displacement of the bolt entering said aperture, means for supporting an alarm controlling switch mounted on said plate member and arranged in said cavity, a pair of brackets fixed on said plate member inside said cavity and arranged above and below said aperture respectively, a U-shaped swinging element pivotally supported on said brackets and including two parallel fins arranged so as to receive between them said bolt entering said aperture and a pair of arms adjacent said brackets, one of which controls said switch, spring means arranged between said arms and brackets and biasing said swinging element in a rest position in which said contacts are open, said bolt engaging one of said fins when undue pressure is exerted on the door thus causing rotation of the swinging element against the force of said spring means, and closing of the contacts of the alarm controlling switch.

3. A device as claimed in claim 1 comprising a plate member fixed to the door jamb and a closing cavity formed therein, an aperture formed in said plate member, a pin member fixed on said door jamb and engaging said aperture when the door is in closed position, said aperture being such as to permit transverse movement of said pin member, means for supporting an alarm controlling switch mounted on said plate member and arranged in said cavity, a bracket fixed on said plate member inside said cavity, a swinging element for actuating said alarm controlling switch pivoted on said plate member and located in said cavity, spring means arranged between said bracket and said swinging element and biasing said swinging element in a rest position in which the contacts of the alarm controlling switch are open, an aperture formed in the swinging element and engaged by said pin member when the door is in closed position, which aperture is offset with respect to the aperture formed in the plate member so that the pin member may abut with its inner edge when undue pressure is exerted on the door thus causing rotation of said swinging element against the force of said spring means and closing of the contacts of the alarm controlling switch.

4. A device as claimed in claim 1, in which said alarm controlling switch comprises a block of insulating material mounted on said plate member, arranged in said cavity and supporting a pair of elastic tangs forming the contacts of said switch, said tangs being normally displaced fron one another, a pin slidably mounted in said block and having one end in engagement on one of said tangs and the opposite end engaged by said swinging element, the rotation of said swinging element by undue pressure on the door causing the pin to bring said tangs into contact.

* * * * *